United States Patent [19]

Berzbach

[11] Patent Number: 4,485,983

[45] Date of Patent: Dec. 4, 1984

[54] WINDING MACHINE

[75] Inventor: Dietmar Berzbach, Nümbrecht, Fed. Rep. of Germany

[73] Assignee: Erwin Kampf GmbH & Co. Maschinenfabrik, Muhlen, Fed. Rep. of Germany

[21] Appl. No.: 488,699

[22] Filed: Apr. 26, 1983

[30] Foreign Application Priority Data

Apr. 30, 1982 [DE] Fed. Rep. of Germany ..... 3216110

[51] Int. Cl.[3] ..... B65H 19/26; B65H 19/02

[52] U.S. Cl. ..... 242/65; 242/67.1 R

[58] Field of Search ..... 242/56 R, 65, 67.1 R, 242/781

[56] References Cited

U.S. PATENT DOCUMENTS

| | | | |
|---|---|---|---|
| 3,086,726 | 4/1963 | Aaron | 242/65 |
| 3,464,645 | 9/1969 | Pearson | 242/78.1 |
| 3,610,545 | 10/1971 | Reifenhauser et al. | 242/56 R |
| 3,998,399 | 12/1976 | Held et al. | 242/65 |
| 4,099,682 | 7/1978 | Benuska | 242/67.1 R X |

*Primary Examiner*—John M. Jillions
*Assistant Examiner*—Lloyd D. Doigan
*Attorney, Agent, or Firm*—Bacon & Thomas

[57] ABSTRACT

A winding machine with a rewind shaft supported between power-operated roll supporting arms, with a pressure roller cooperating with the rewind shaft, and with a supporting drum for the rewind shaft and/or the roll, respectively. The technical problem of the invention is a simple supporting of the rewind shaft and/or the roll which does not impede the pivoting of the rewind shaft for the change of the roll as well as the pulling out of the rewind shaft from the roll pivoted down. By the superposition of the pivoting motions of roll supporting arms and pivoting levers the supporting drum supports the roll substantially from below for any roll diameter. By the continuation of the pivoting motions of the roll supporting arms as well as of the supporting drum beyond the winding range, supporting drum and roll move away from one another so far that the roll can be placed on a pallet or on a carriage, without the supporting drum being impeding.

9 Claims, 3 Drawing Figures

WINDING MACHINE

BACKGROUND OF THE INVENTION

1. FIELD OF THE INVENTION

The invention relates to a winding machine with a rewind shaft supported between power-operated roll supporting arms, with a pressure roller cooperating with the rewind shaft, and with a supporting drum for the rewind shaft and/or the roll, respectively.

2. DESCRIPTION OF THE PRIOR ART

Such winding machines are normally combined with a slitting machine. The working width and, thus, also the axial length of the rewind shaft is comparatively large. The working width is up to several meters. In order that the rolls have a utilizable space as large as possible, the rewind shaft is comparatively thin so that the rewind shaft and/or the roll, respectively, must be supported during the operation, in order to avoid undesired axial deflection.

For the supporting, one knows supporting drum winding devices having slides movable in vertical direction for the supporting drum. Such an arrangement requires high constructional and mechanical expenditure. Primarily, the straight-line guide of the slide is extremely complicated. Furthermore, a special taking-out device for the roll is necessary.

SUMMARY OF THE INVENTION

It is the object of the present invention to provide such a configuration of a slitting machine that a straight-line guide is not necessary for the supporting of the rewind shaft, and that the pivoting-out of the rewind shaft for the change of the roll is not impeded by the supporting drum.

According to the invention this object is achieved in that by the superposition of the pivoting motions of roll supporting arms and pivoting levers the supporting drum supports the roll substantially from below for any roll diameter, and that by the continuation of the pivoting motions of the roll supporting arms as well as of the supporting drum beyond the winding range, supporting drum and roll move away from one another so far that the roll can be placed on a pallet or on a carriage, without the supporting drum being impeding.

In detail the invention is characterized by the following features:

(a) the pivoting shaft of the roll supporting arms is positioned about vertically beneath the center of the effective pivoting path;

(b) the supporting drum is supported by pivoting levers;

(c) the length of the pivoting levers is about equal to the length of the roll supporting arms;

(d) the pivoting shaft of the pivoting levers, in regard to the pivoting shaft of the roll supporting arms is laterally displaced in the direction of the pressure roller about by half the length of the full length of a pivoting lever.

The invention differs from the prior art in a nonobvious manner in that the pivoting curve of the supporting drum is combined with the pivoting curve upon which the rewind shaft moves, in such a manner that within the effective pivoting path the supporting drum supports the rewind shaft and/or the roll, respectively, about vertically beneath the rewind shaft.

In detail the arrangement is made in such a manner that the supporting line of the supporting drum on the roll is situated on the opposite side of the shaft as the pressure roller so that the roll is pretensioned by the supporting drum against the pressure roller.

As a further development the invention provides that the pivoting levers have a bending in the direction of the pivoting shaft of the roll supporting arms. By this it is achieved that the pivoting levers can be pivoted away entirely for the roll change and that they do not impede the pivoting out of the rewind shaft. Consequently, the rewind shaft and roll may be placed on a pallet.

In order to ease the change of the roll, the invention further provides that a roll supporting are together with the rewind shaft is shiftable on an extension of the pivoting shaft so that the rewind shaft can be moved out of the roll. The rewind shaft may be moved out of the roll in axial direction. By this an extremely quick and simple roll change is possible without a complicated handling of the rewind shaft with roll being necessary.

For confined floor space facilitates the invention provides a modification of the finished roll withdrawal in such a manner that a roll supporting arm is disconnectable from the other roll supporting arm and is independently pivotable, and that the roll is removable in axial direction from the rewind shaft. After placing the roll on a pallet carriage, consequently one of the roll supporting arms is released form the rewind shaft and is pivoted up. The pallet carriage with the roll may be moved away axially in regard to the rewind shaft. The rewind shaft remains supported in overhung position for a re-tooling.

BRIEF DESCRIPTION OF THE DRAWINGS

One embodiment of the invention will be described in the following with reference to the attached drawings, wherein.

DESCRIPTION OF THE PREFERRED EMBODIMENT

Figure 1:
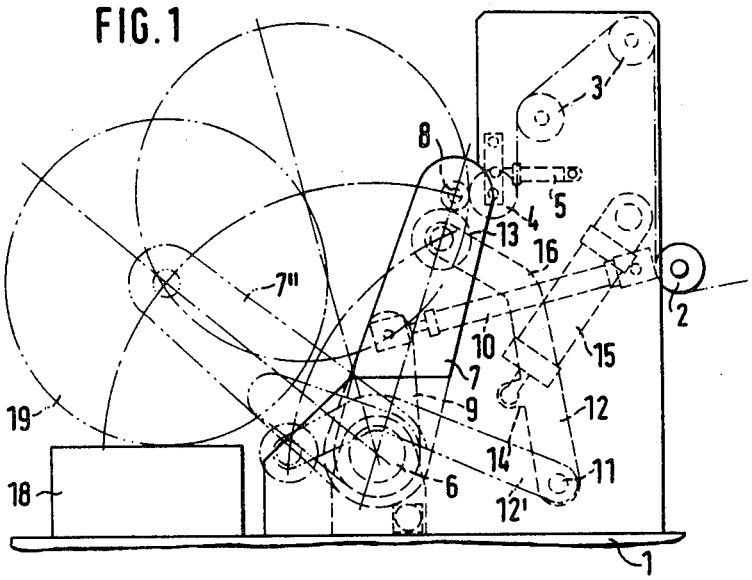
FIG. 1 is a side view of a winding machine according to the invention.

FIG. 1 shows a winding machine combined with a slitting machine. Only the essential structural members of the machine are illustrated. Between bearing plates 1 guide rollers 2 and 3 are well as a pendulous pressure roller 4, pretensioned by a pneumatic cylinder 5, are beared. The guide rollers 2 and 3 belong to the longitudinal slitting device, not shown in detail. On a pivoting shaft 6 roll supporting arms 7, 7' are supported which bear a rewind shaft 8 having a specific winding drive. The roll supporting arms 7 are connected with setting rods 9; hydraulic cylinders 10 are provided for the operation thereof.

According to the invention, on a pivoting shaft 11, pivoting levers 12 are supported which receive a supporting drum 13. On a projection 14 of each pivoting lever, a pneumatic cylinder 15 acts on for the adjustment of the pivoting levers 12. The length of the pivoting levers 12 corresponds to about the length of the roll supporting arms 7. The pivoting levers 12 possess a bending 16 towards the pivoting shaft 6. The pivoting shaft 11 is situated somewhat lower than the pivoting shaft 6. In addition, the pivoting shaft 11 is displaced to the right, relates to FIG. 1, in regard to the pivoting shaft 6, by about half the length to the full length of a pivoting lever. In detail, this displacement is two thirds to three quarters of the length of a pivoting lever. The pivoting shaft 6 is about vertically beneath the center of the pivoting path of the rewind shaft.

Figure 2:
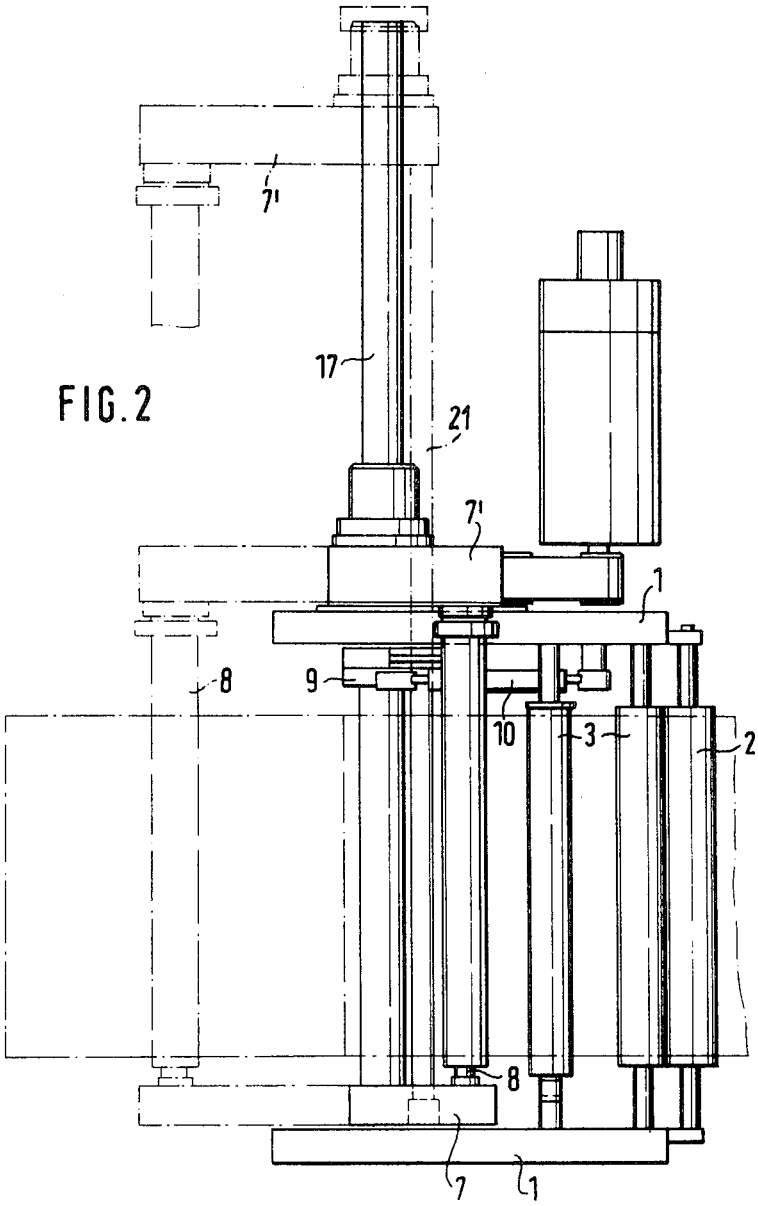
FIG. 2 is a top view in regard to FIG. 1, whilst

FIG. 2 shows an extension 17 of the pivoting shaft 6. On this extension 17, the roll supporting arm 7' is displaceable in axial direction by means of an hydraulic cylinder 21 so that it can be moved from the working position drawn in unbroken lines after pivoting into the resting position as drawn in dot-and-dash lines. FIG. 1 shows a possibly movable pallet for the depositing of a finished roll.

Figure 3:
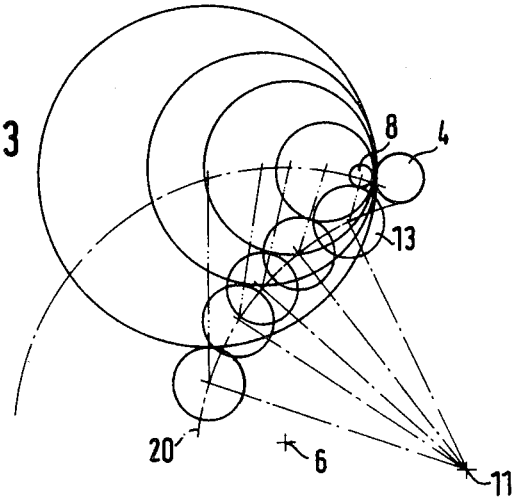
FIG. 3 is a schematic representation of different supporting positions of the roll.

FIG. 3 shows schematically a plurality of positions in the working sequence of the winding machine. One recognizes the pressure roller 4 as well as the rewind shaft 8 in different positions during the winding operation. Furthermore, the pivoting shaft 6 of the roll supporting arms, not shown, and the pivoting shaft 11 of the pivoting lever 12, also not shown, for supporting drums 13 are shown. On the basis of the geometrical arrangement as described the supporting drum 13 supports the rewind shaft 8 and/or the roll, respectively, in such a manner that the supporting line is situated on the opposite side of the shaft as the pressure roller 4. In the course of the rewind operation the diameter of the roll increases. Accordingly the rewind shaft 8 is moved away from the pressure roller 4 by the hydraulic cylinders 10. In FIG. 3 five working positions are shown during the winding operation. According to the increase of the roll diameter and the pivoting of the roll supporting arms the pivoting levers 12 are lowered so that the supporting drum 13 moves on an arc of a circle 20. It is evident by FIG. 3 that the supporting line always is substantially beneath the axis of the roll. However, the supporting line is on the opposite side as the pressure roller 4 so that a force component is always effective in abutting the roll against the pressure roller 4. Therefore it is guaranteed that by the pivoting of the pivoting levers 12 the supporting drum 13 always supports the rewind shaft and/or the roll, respectively, substantially vertically below the axis so that axial deflections are avoided.

For the roll change the pivoting levers 12 are pivoted towards the position 12' drawn in dot-and-dash lines. Due to the bending 16 an extensive pivoting away is possible so that the supporting drum 13 descends beneath the pivoting axle 6. The roll supporting arms 7 may be pivoted out now entirely into the depositing position 7''. The roll 19 is placed upon the pallet 18. Now, by the aid of the hydraulic cylinder 21 the roll supporting arm 7', together with the rewind shaft 8, is moved on the extension 17 so that the rewind shaft 8 is pulled out of the winding core. Then the roll 19 may be transported away on the pallet 18. An empty winding core is mounted on the rewind shaft 8, and the roll supporting arm is moved back to the working position 7'. Then a new roll may be rewound.

We claim the following:

1. A winding machine comprising a rewind shaft for a roll, roll supporting arms to support the rewind shaft and pivot the rewind shaft in a first path about a first axis, a pressure roller cooperating with the rewind shaft, a supporting drum to support the rewind shaft, pivoting levers to support the supporting drum, and pivot the supporting drum in a second path about a second axis; said winding machine having a range of winding positions wherein the roll supporting arms position the rewind shaft drum at a position along the first path as the pivoting levers position the supporting drum at a position along the second path so that the position of the supporting drum is substantially aligned below the position of a roll on the rewind shaft whereby said supporting drum supports a roll on the rewind shaft substantially from below for any roll diameter throughout the range of winding positions; said winding machine having a position beyond the range of winding positions, wherein, as the rewind shaft continues to pivot along the first path beyond the range of winding positions and the supporting drum continues to pivot along the second path beyond the range of winding positions, the supporting drum moves to a position where it is no longer substantially below a roll on the rewind shaft so that the roll can be placed on top of a pallet without interference with the supporting drum.

2. A winding machine as claimed in claim 1 wherein the first axis is positioned approximately vertically beneath the center of the first path, wherein the length of the pivoting levers is approximately equal to the length of the roll supporting arms, wherein the second axis and the pressure roller respectively lie in vertical planes which are on the same side of the vertical in which the first axis lies, and wherein the distance between the second axis and the first axis is approximately one half the length of the pivoting levers.

3. A winding machine according to claim 2, wherein the displacement of the pivoting levers in regard to the second axis is two thirds to three quarters of the length of a pivoting lever.

4. A winding machine according to claim 3, characterized in that the second axis is arranged about on the same level or somewhat lower in the vertical direction than the first axis.

5. A winding machine according to claim 1, wherein the supporting line of the supporting drum on the roll is situated substantially beneath the rewind axis or somewhat on the opposite side of the rewind axis as compared with the pressure roller so that the roll is pretensioned against the pressure roller by the support.

6. A winding machine according to claim 5 wherein the pivoting levers are coupled with a pneumatic operating device.

7. A winding machine according to claim 6, wherein the pivoting levers possess a bending so that the end supporting the support drum is bent in the direction of the pivoting shaft of the roll supporting arms.

8. A winding machine according to claim 7, wherein a roll supporting arm, together with the rewind shaft is shiftable on an extension of the pivoting shaft so that the rewind shaft can be moved out of the roll.

9. A winding machine according to claim 7, wherein the roll supporting arm is disconnectable from the other roll supporting the arm and is independently swingable, and that the roll can be pulled away in axial direction from the rewind shaft.

* * * * *